US006146100A

United States Patent [19]

Broucke

[11] Patent Number: 6,146,100

[45] Date of Patent: Nov. 14, 2000

[54] COMPRESSOR UNIT AND CONTROL DEVICE USED THEREBY

[75] Inventor: Stijn Broucke, Aartselaar, Belgium

[73] Assignee: Atlas Copco AirPower, naamloze vennootschap, Wilrijk, Belgium

[21] Appl. No.: 09/263,497

[22] Filed: Mar. 8, 1999

[30] Foreign Application Priority Data

Mar. 10, 1998 [BE] Belgium ..... 09800186

[51] Int. Cl.[7] ..... F04B 49/00; F04B 49/06

[52] U.S. Cl. ..... 417/28; 417/36; 417/44.2; 417/295

[58] Field of Search ..... 417/26, 28, 36, 417/38, 44.2, 295

[56] References Cited

U.S. PATENT DOCUMENTS

| | | | |
|---|---|---|---|
| 3,788,776 | 1/1974 | Post et al. | 417/295 |
| 4,401,413 | 8/1983 | Dickens | 417/26 |
| 4,515,515 | 5/1985 | Segonne | 417/26 |
| 4,664,601 | 5/1987 | Uchida et al. | 417/28 |
| 4,863,355 | 9/1989 | Odagiri et al. | 417/28 |
| 4,998,862 | 3/1991 | Hutchinson | 417/28 |
| 5,443,369 | 8/1995 | Martin et al. | 417/53 |

FOREIGN PATENT DOCUMENTS 0 294 072 A2 12/1988 European Pat. Off. .

*Primary Examiner*—Charles G. Freay
*Assistant Examiner*—Michael K. Gray
*Attorney, Agent, or Firm*—Bacon & Thomas, PLLC

[57] ABSTRACT

In the inlet pipe (7) of the compressor element (1) is provided a pneumatically controlled throttle valve (9), whereas the motor (3) of the compressor element (1) has a pneumatically controlled speed regulator (6). This speed regulator (6) and the throttle valve (9) are both connected to the compressed air receiver (14) via a compressed air pipe (26) and a control device (18). This control device (18) contains an electropneumatic valve (19) in the compressed air pipe (26) which is coupled to an electronic control (20), whereas a pressure sensor (21) is connected to the compressed air receiver (14) and a pressure sensor (22) is erected in the compressed air pipe (26) between the valve (19) and the speed regulator (6) and the throttle valve (9). The control (20) is connected to both pressure sensor (21 and 22) and contains means to control the electropneumatic valve (19) as a function of the measured air receiver pressure and the measured regulating pressure which has been fed back, as well as an electronically adjusted nominal pressure.

5 Claims, 1 Drawing Sheet

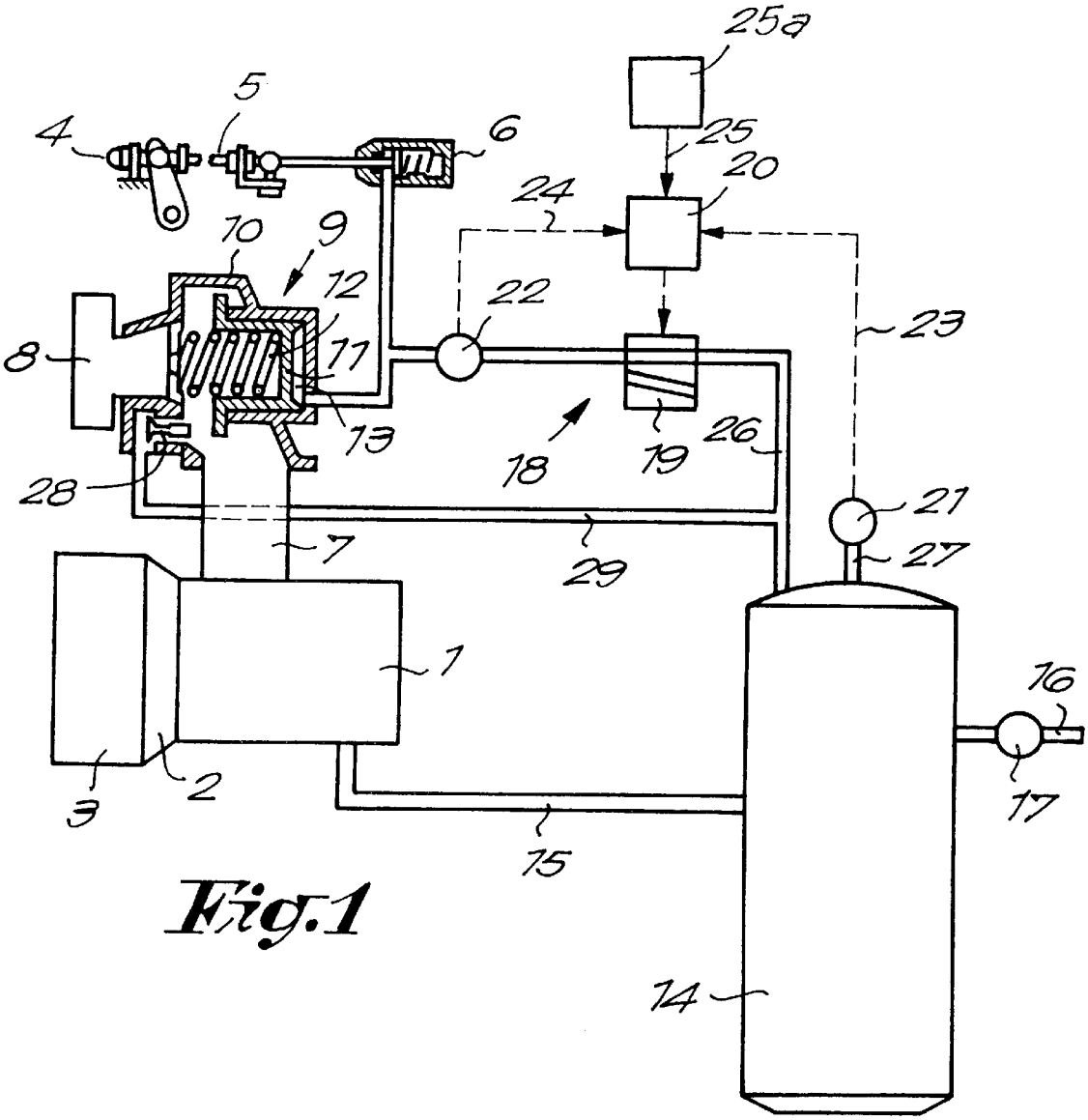
Fig.1
Fig.2
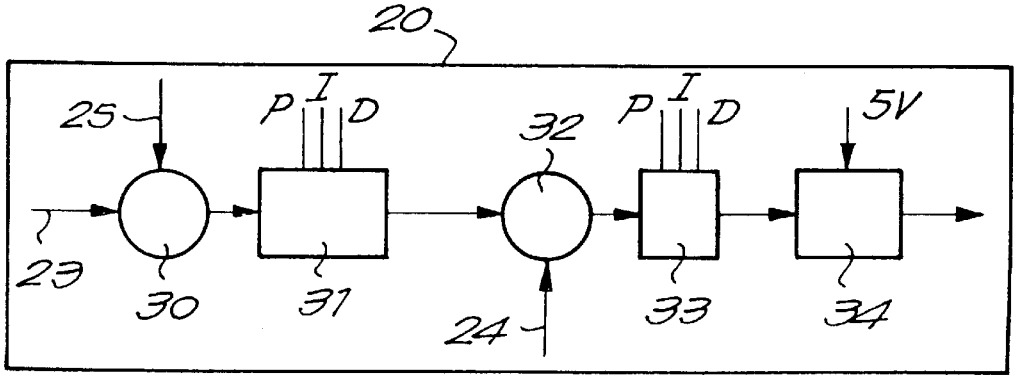

COMPRESSOR UNIT AND CONTROL DEVICE USED THEREBY

BACKGROUND OF THE INVENTION

1. Field of the Invention

The present invention concerns a compressor unit containing a compressor element driven by a motor which is provided with an outlet pipe and an inlet pipe, and a compressed air receiver onto which the outlet pipe is connected, whereby a pneumatically controlled throttle valve is provided in the inlet pipe, whereas the motor has a pneumatically controlled speed regulator and both this speed regulation and the throttle valve are connected to the compressed air receiver via a compressed air pipe and a control device with a control valve in the compressed air pipe.

2. Description of the Related Art

With known compressor units of the above type, the control device contains two valves erected in parallel, namely a pneumatic control valve and an electromechanical load valve. The pipe which is connected to the compressed air receiver via these two valves is connected to the connecting pipe between the speed regulator and the throttle. Onto this connecting pipe are connected branches which are provided with small air holes.

The output of the compressor element depends on the rotational speed of the motor and thus of the speed regulator and the throttle in the inlet pipe.

The rotational speed and the throttle are adjusted by means of the regulating pressure which is built up by the pneumatic control valve on the basis of the pressure in the compressed air receiver.

The nominal pressure, i.e. the operating pressure under full load, is adjusted manually by means of the control valve. If the air receiver pressure is equal to the nominal pressure while load-running, the regulating pressure is zero, the throttle valve is entirely open and the rotational speed of the motor is maximal.

If however, the air receiver pressure is higher, in particular maximal, for example 2 bar above the nominal pressure, the rotational speed is minimal and the throttle valve is entirely closed. The regulating pressure is proportional to the difference between the air receiver pressure and the nominal pressure.

Between no regulating pressure and the maximum regulating pressure, any output can be set between the maximum and zero respectively.

Since the pneumatic control valve only lets air through in one direction, the above-mentioned blow-off holes are necessary. By letting air escape via these blow-off holes, it is possible for the regulating pressure to drop when the air receiver pressure is lowered.

By means of pipe restrictions and volumes to be filled, the regulating pressure dynamically approaches a first-order process. With a lowering and rising load, the variation of the air receiver pressure will be retarded. This results in an overshoot (air receiver pressure too high) when the load diminishes, and in an undershoot (air receiver pressure too low) when the load increases.

The load valve is required in order to be able to start under no-load conditions, with a minimal rotational speed and a closed throttle valve. This load valve, which bridges the regulating valve, is opened when starting, so that the air receiver pressure can act directly on the throttle valve and the speed regulation. The air receiver pressure then amounts to for example 2 bar.

When the compressor element is loaded, the load valve is shut and the regulating pressure is blown off via the blow-off holes, after which the above-described adjustment under load takes place.

SUMMARY OF THE INVENTION

The present invention provides a compressor unit which does not have the above-mentioned and other disadvantages, and which allows for a better adjustment, in particular with less or no deviation between the nominal pressure and the air receiver pressure under different loads, whereby the air receiver pressure does not rise so much when the load is lowered (smaller overshoot).

This aim is reached according to the invention in that the regulating valve is an electropneumatic valve which is coupled to an electronic control, whereas a pressure gauge is connected to the compressed air receiver which transforms the pressure in the compressed air receiver in an electric signal, and in that a pressure sensor is installed in the compressed air pipe between the electropneumatic valve and the speed regulation and the throttle valve in order to feed back the regulating pressure exerted on this speed regulation and the throttle valve and to transform it in an electric signal, whereby the control is electrically connected to both pressure sensors and contains means to control the electropneumatic valve as a function of the measured air receiver pressure and the measured regulating pressure which has been fed back, as well as an electronically adjusted nominal pressure.

Preferably, the control contains means to compare the measured air receiver pressure with the electronically adjusted nominal pressure, means to determine the required regulating pressure on the basis of the deviation of the air receiver pressure in relation to the nominal pressure, and means to compare this required regulating pressure with the measured regulating pressure, and to transmit a signal as a function of the result of this comparison for the control of the electropneumatic valve.

The present invention also concerns a control device which is clearly designed to be used in a compressor unit according to any of the preceding embodiments.

BRIEF DESCRIPTION OF THE DRAWINGS

In order to better explain the characteristics of the invention, a compressor unit and control device used thereby according to the invention are described as an example only without being limitative in any way, with reference to the accompanying drawings, in which:

FIG. 1 schematically represents a compressor unit according to the invention;

FIG. 2 represents a block diagram of the control device according to the invention of the compressor unit in FIG. 1.

DETAILED DESCRIPTION OF THE PREFERRED EMBODIMENTS

The compressor unit which is represented in FIG. 1 contains a compressor element 1 which is driven by a motor 3 via a transmission 2.

This motor 3 is a combustion engine whose fuel supply 4 is connected to a pneumatic speed regulator 6 via a mechanical clutch 5.

Onto the compressor element 1 is connected an inlet pipe 7 which opens into the environment via one or several filters 8. In this inlet pipe 7 is provided a pneumatically controlled throttle valve 9.

This throttle valve 9 contains a housing 10, a part of which forms part of the inlet pipe 7, and a valve element 11 which can be shifted in said housing 10.

This valve element 11 is pushed open by a spring 12.

On the other side of the spring 12, between the valve element 11 and the housing 10, is formed a closed chamber 13 whose volume can vary.

Naturally, the above-mentioned valve may also be of another type, and it may for example be a butterfly valve, whereby the valve element 11 is then rotatable instead of slidable.

The compressor unit also contains a compressed air receiver 14 which simultaneously functions as an oil separator and which is connected to the compressor element 1 via the outlet pipe 15. The compressed air receiver 14 is equipped with an outlet pipe 16 itself, in which is provided a valve 17.

The compressor unit further contains a control device 18 to control the speed regulator 6 and the throttle valve 9.

This control device 18 mainly consists of an electropneumatic valve 19, an electronic control 20 connected onto it and two pressure sensors 21 and 22 which measure a pressure and transform it in an electric signal and which are electrically connected to the electronic control 20 via lines 23 and 24. An electronic signal can be added to the control 20, established or adjusted manually in an operating panel 25*a*. The value of this electronic signal corresponds to the nominal pressure.

The electropneumatic valve 19 is provided in a compressed air pipe 26 which is connected to the compressed air receiver 14 on the one hand and which splits in two on the other hand and is connected to the chamber 13 of the throttle valve 9 and the cylinder of the suction mechanism which forms the speed regulator 6.

The pressure sensor 22 is also provided in the compressed air pipe 26, between the electropneumatic valve 19 and the bifurcation of this compressed air pipe 26.

The pressure sensor 21 is connected to the compressed air receiver 14 via a pipe 27.

In the housing 10, downstream of the throttle valve 9, a blow-off valve 28 has also been built in which is connected to the pipe 26 in the vicinity of the compressed air receiver 14 by means of a blow-off pipe 29.

As is represented in FIG. 2, the electronic control 20 is a PLC (programmable logic controller) containing a comparing means 30 for comparing the pressure in the air receiver 14 to an adjusted nominal pressure.

The pressure in the air receiver 14 measured by the pressure sensor 21 and the measured air receiver pressure is converted to an electronic signal and sent along line 23 to the comparing means 30 in the electronic control 20.

The equivalent electronic signal for the nominal pressure, adjusted manually by the means 25*a*, is conveyed through line 25 to the comparing means 30 in the electronic control 20.

Comparing means 30 then compares the measured pressure in the air receiver 14 with the adjusted nominal pressure so that a first difference in pressure signal is output to a transforming means 31.

Transforming means 31 transforms the first difference in pressure signal to a required pressure regulating signal and transmits the required pressure regulating signal to a second comparing means 32 which compares the required pressure regulating signal, which corresponds to a required pressure, with the actual or measured regulating pressure detected in pressure gauge 22 which signal has been sent to second comparing means 32 via line 24.

In the second comparing means 32, a second difference in pressure is calculated which is the difference between the required pressure input from transferring means 31 and the actual pressure input from pressure gauge 22 via line 24 so that a second difference in pressure signal is output to transmitting means 33 which transmits a signal to the electropneumatic valve 19 as a result of the second calculated difference.

The means 31 and 33 may be PID(Proportional integral derivative) controls, as is schematically represented in FIG. 2, whereby the PID control forming the means 31 provides for the master control and whereby the other PID control is a slave control. Both operate according to the conventional PID algorithm:

$$Y_k = K \cdot \left( X_k \cdot R + TI \cdot \sum_{i=0}^{k} X_i + TD \cdot X_k - TD \cdot X_{k-1} \right)$$

whereby: R, TI and TD are the parameters of the PID control;

X is the difference between the adjusted nominal pressure and the measured air receiver pressure at the master control, and the difference between the required regulating pressure and the measured regulating pressure at the slave control;

K is a constant which is −1 at the master control and +1 at the slave control.

On the outlet of the slave control and thus of the means 33, an offset can be added in 34 which coincides with the voltage at which the electropneumatic valve 19 is shut, for example 5 Volt.

According to a variant, the function of the second PID control or slave control can be limited to a reinforcement of the outgoing signal of the master control.

The working of the compressor unit and the control device 18 is as follows.

The electronic control device 18 determines what voltage is applied to the electropneumatic valve 19 and thus the pass section of this electropneumatic valve 19 by means of the air receiver pressure measured by the pressure gauge 21, the fed-back regulating pressure measured by the pressure sensor 22 and the nominal pressure which has been manually adjusted in 25.

As soon as the pressure in the compressed air receiver 14 exceeds the nominal pressure, the means 30 will transmit a signal to the means 31, which will generate a required regulating pressure as a function of the measured difference, which is then compared with the actual fed-back regulating pressure exerted on the speed regulator 6 and the throttle valve 9 by the means 32. As a function of the latter difference, the control 20 applies a voltage to the electropneumatic valve 19 which further opens the compressed air pipe 26, such that the throttle valve 9 shuts further and the rotational speed of the motor 3 is reduced.

At a regulating pressure of two bar, the rotational speed is minimal and the throttle valve 9 is shut completely.

In an analogous manner, when the pressure in the compressed air receiver 14 is lower than the nominal pressure, the means 30 will also transmit a signal to the means 31, and, as a function of the difference between the required regulating pressure generated by these means 31 and the fed-back regulating pressure, the electropneumatic valve 19 will further shut the compressed air pipe 26 via the control 20, as a result of which the throttle valve 9 opens further and the speed of the motor 3 increases.

When the regulating pressure is zero bar, which implies that the pressure in the compressed air receiver 14 and thus in the outlet pipe 15 is equal to the nominal pressure, the rotational speed is maximal and the throttle valve 9 is entirely open.

When the throttle valve 9 is entirely closed, the valve element 11 pushes the blow-off valve 28 open, so that air can escape from the compressed air receiver 14 via the blow-off pipe 29.

When running idle, the nominal pressure is equal to zero and the control 20 will place the electropneumatic valve 19 in this position whereby the part of the pipe 26 which is connected to the speed regulator 6 and the throttle valve 9 is connected to the compressed air receiver.

The above-described control device 18 is more efficient than a strictly pneumatic control device. The deviation of the air receiver pressure in relation to the nominal pressure under different loads is excluded. When the load diminishes, the surplus or the temporary excess pressure in the compressed air receiver is lower. Also the stability is better.

If no air is blown off for a longer while, the air receiver pressure can be automatically set at a lower value, which will result in fuel savings.

The electronic control 20 must not necessarily be composed as described above. Instead of applying the above-described master/slave principle, one can also apply other control strategies such as a fuzzy logic or model-based control system.

The invention is by no means restricted to the above-described embodiment represented in the accompanying drawings; on the contrary, such a compressor unit and control device can be made in all sorts of variants while still remaining within the scope of the invention.

What is claimed is:

1. A compressor unit containing a compressor element (1) driven by a motor (3) which is provided with an outlet pipe (15) and an inlet pipe (7), and a compressed air receiver (14) onto which the outlet pipe (15) is connected, whereby a pneumatically controlled throttle valve (9) is provided in the inlet pipe (7), whereas the motor (3) has a pneumatically controlled speed regulator (6), and whereby the speed regulator (6) and the throttle valve (9) are connected to the compressed air receiver (14) via a compressed air pipe (26), said compressed air pipe having a control device (18) with a control valve therein characterized in that the control valve is an electropneumatic valve (19) which is coupled to an electronic control (20), and wherein a first pressure sensor (21) is connected to the compressed air receiver (14) which transforms a measured compressed air receiver pressure in the compressed air receiver (14) to an electric signal;

a second pressure sensor (22) is installed in the compressed air pipe (26) between the electropneumatic valve (19) and the speed regulator (6) and the throttle valve (9) in order to measure an actual regulating pressure exerted on said speed regulator (6) and the throttle valve (9) and to transform the measured regulating pressure to an electric signal, and whereby the electronic control (20) is electrically connected to said first and second pressure sensors (21 and 22) and to a means for adjusting nominal pressure **(25*a*) which adjusts a nominal pressure, said electronic control (20) having means for controlling the electropneumatic valve (19) according to the signals received from said first and second pressure sensors (21 and 22) and according to a signal received from said means for adjusting nominal pressure (25)**.

2. A compressor unit according to claim 1, characterized in that the electronic control (2)) contains means for comparing (30) the measured air receiver pressure with the adjusted nominal pressure so that a first difference in pressure signal is output to a transforming means (31) which transforms the first difference in pressure signal to a required pressure regulating signal and transmits the required pressure regulating signal, corresponding to a required pressure, to a second comparing means (32) which compares the required pressure with the measured actual regulating pressure detected by said second pressure gauge (22), said second comparing means (32) calculating a difference between the required pressure and the measured actual pressure and outputting a second difference signal corresponding to said difference between the required pressure and the measured actual pressure.

3. A compressor according to claim 2, wherein the electronic control (20) is a programmable logic controller (PLC) and the transforming means (31) contains a proportional integral derivative (PID) control.

4. A compressor according to claim 2, wherein said signal corresponding to the difference between the required pressure and the actual pressure is a second difference signal, said second difference signal being received by a transmitting means (33) which transmits said second difference signal to said electropneumatic valve (19) to control the operation thereof, said transmitting means 33 containing a proportional integral derivative (PID) control.

5. A compressor according to claim 4, wherein said transmitting means performs a reinforcing function.

* * * * *